US009758923B2

(12) United States Patent
Farris

(10) Patent No.: US 9,758,923 B2
(45) Date of Patent: Sep. 12, 2017

(54) PORTABLE STEAMING SYSTEM FOR ARTICLES OF FOOTWEAR

(71) Applicant: NIKE, Inc., Beaverton, OR (US)

(72) Inventor: Bryan N. Farris, North Plains, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/663,189

(22) Filed: Mar. 19, 2015

(65) Prior Publication Data

US 2016/0273152 A1 Sep. 22, 2016

(51) Int. Cl.

| | |
|---|---|
| ***D06F 73/00*** | (2006.01) |
| ***D06F 73/02*** | (2006.01) |
| ***A43D 11/14*** | (2006.01) |
| ***A47B 61/04*** | (2006.01) |
| *A47L 23/20* | (2006.01) |
| *D06F 58/14* | (2006.01) |

(52) U.S. Cl.

CPC ..... *D06F 73/00* (2013.01); *A43D 11/14* (2013.01); *A47B 61/04* (2013.01); *D06F 73/02* (2013.01); *A47L 23/20* (2013.01); *D06F 58/14* (2013.01)

(58) Field of Classification Search

CPC ..... A43D 11/14; A43D 11/145; A47J 39/003; D06F 73/02; D06F 58/203; D06F 73/00; D06F 58/14; A47L 23/20; A47L 23/205; A47B 61/04

See application file for complete search history.

(56) References Cited

U.S. PATENT DOCUMENTS

| | | | | |
|---|---|---|---|---|
| 2,275,334 A | | 3/1942 | Young | |
| 2,387,724 A | | 10/1945 | Elman et al. | |
| 2,943,452 A | * | 7/1960 | Buchanan | A47J 39/003 62/183 |
| 3,007,183 A | | 11/1961 | Kamborian et al. | |
| 3,302,305 A | | 2/1967 | Little | |
| 3,601,292 A | * | 8/1971 | Bliss | D06F 73/02 223/51 |
| 3,752,373 A | * | 8/1973 | Smith | D06F 73/02 219/401 |
| 4,783,967 A | * | 11/1988 | Mullen | A47F 1/03 221/150 HC |

(Continued)

FOREIGN PATENT DOCUMENTS

| | | |
|---|---|---|
| CN | 2256901 Y | 6/1997 |
| DE | 2833384 | 2/1980 |

(Continued)

OTHER PUBLICATIONS

International Search Report and Written Opinion mailed Jun. 2, 2016 for PCT Application No. PCT/US2015/068051.

(Continued)

*Primary Examiner* — Ismael Izaguirre

(74) *Attorney, Agent, or Firm* — Banner & Witcoff, Ltd.

(57) ABSTRACT

A steaming system includes a housing with a lid, a steaming compartment, and a heating chamber. The system also includes provisions for generating steam and exposing articles to the steam. Articles of apparel, including articles of footwear, may be placed in steaming system to help customize the articles of apparel for a user's fit and comfort. The steaming system can be configured to be portable and carried by a person.

22 Claims, 10 Drawing Sheets

(56) References Cited

U.S. PATENT DOCUMENTS

| | | | | |
|---|---|---|---|---|
| 5,074,292 | A | 12/1991 | Cox | |
| 5,405,312 | A | 4/1995 | Jacobs | |
| 5,528,912 | A | 6/1996 | Weber | |
| 5,548,848 | A | 8/1996 | Huybrechts | |
| 5,730,006 | A * | 3/1998 | Conley | A47G 25/54 223/51 |
| 5,842,287 | A * | 12/1998 | Murphy | A47K 10/06 219/400 |
| 6,793,881 | B2 * | 9/2004 | Himes | A61L 9/12 34/104 |
| 7,765,718 | B2 | 8/2010 | Wilkenfeld | |
| D645,975 | S * | 9/2011 | Barkey | D24/108 |
| 8,033,393 | B2 | 10/2011 | Baker et al. | |
| 8,261,658 | B1 | 9/2012 | Rouse | |
| 9,456,661 | B2 * | 10/2016 | Dieter | A43D 95/12 |
| 2002/0154011 | A1 * | 10/2002 | Pasin | D06F 73/02 340/540 |
| 2003/0178411 | A1 | 9/2003 | Manganiello et al. | |
| 2008/0222909 | A1 * | 9/2008 | Picozza | D06F 58/14 34/195 |
| 2008/0249446 | A1 | 10/2008 | Baumgartner et al. | |
| 2008/0256989 | A1 * | 10/2008 | Jeong | D06F 58/14 68/5 C |
| 2010/0199406 | A1 | 8/2010 | Dua et al. | |
| 2012/0090068 | A1 | 4/2012 | Glass et al. | |
| 2012/0180190 | A1 | 7/2012 | McNamee | |
| 2012/0227282 | A1 | 9/2012 | Hawkinson et al. | |
| 2014/0169704 | A1 | 6/2014 | Dieter et al. | |
| 2014/0365360 | A1 * | 12/2014 | Ely | B08B 3/00 705/39 |

FOREIGN PATENT DOCUMENTS

| | | |
|---|---|---|
| GB | 2345493 A | 7/2000 |
| SU | 833194 | 5/1981 |

OTHER PUBLICATIONS

Kieran Alger, "New Nike FlyKit Lunar1+ come steamed for the perfect fit," Feb. 11, 2013, pp. 1-7 http://www.t3.com/news/new-nike-flyknit-lunar1-come-steam-fitted-for-the-perfect-fit.

Paul Sawers, "Watch: Nike's new FlyKnit Lunar1+ running shoes can be steam-fitted in-store," Feb. 1, 2013, pp. 1-8, http://thenextweb.com/insider/2013/02/01/as-nike-launches-its-new-flyknit-one-range-tnw-checks-out-its-new-steam-lounge/.

YouTube Video entitled "Nike Flyknit One+ Steaming Lounge/The Next Web," dated Feb. 1, 2013 and available at https://www.youtube.com/watch?v=L26UvkYsb3o plus screenshots from this Video.

* cited by examiner

PORTABLE STEAMING SYSTEM FOR ARTICLES OF FOOTWEAR

BACKGROUND

The present embodiments relate generally to steaming systems, and in particular to steaming systems for articles of apparel.

A steaming system can be used to soften articles of apparel. Steam systems often include a mechanism for producing or applying steam. Articles of footwear often include an upper and a sole structure. The upper comprises many different components, including various layers, sections or segments of material. These components may be made from stock textile materials such as fabrics and leather goods that may be customized for a user.

SUMMARY

In one aspect, the present disclosure is directed to a man-portable steaming system. The system comprises a housing, where the housing is dimensioned so as to be carried by a person, and the housing has a weight configured to be moved by a person. The steaming system also includes at least one handle disposed along a portion of the housing that is configured to facilitate the carrying of the steaming system, a compartment configured to receive one or more articles of apparel and a heating chamber configured to provide steam to the compartment. Furthermore, the steaming system includes a lid providing access to the compartment and a power cord.

In another aspect, the present disclosure is directed to a steaming system comprising a housing, where the housing includes a first sidewall, a second sidewall, a front wall, a rear wall, a top surface, a lid, and a base portion. The first sidewall, the second sidewall, the front wall, and the rear wall are each attached to the base portion. The housing further includes an open state and a closed state. The lid comprises a first wall and a second wall, and the lid also includes a bent region, where the first wall and the second wall are joined together along the bent region. The lid is raised to form a first opening and a second opening when the housing is in the open state, where the first opening is disposed along a plane associated with the front wall, and where the second opening is disposed along a plane associated with the top surface. The steaming system also includes a compartment configured to receive one or more articles of apparel, and a heating chamber configured to provide steam to the compartment, where the steam evacuates the compartment through the first opening and the second opening when the housing is in the open state.

In another aspect, the present disclosure is directed to a steaming system comprising a housing, where the housing includes a first sidewall, a second sidewall, and a base portion, and a steaming compartment configured to receive one or more articles of apparel. The first sidewall, the second sidewall, the front wall, and the rear wall are each attached to the base portion. The base portion includes a heating chamber configured to heat water and provide steam to the steaming compartment. The steaming system further includes a plurality of rails, where the plurality of rails includes a first rail, and the first rail extends from the first sidewall to the second sidewall. The first rail is configured to receive at least a portion of one or more articles of apparel. The steaming system also includes a plurality of sleeves, where the plurality of sleeves includes a first sleeve, where the first rail is disposed within the first sleeve, and where the first sleeve is configured to protect the first rail.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
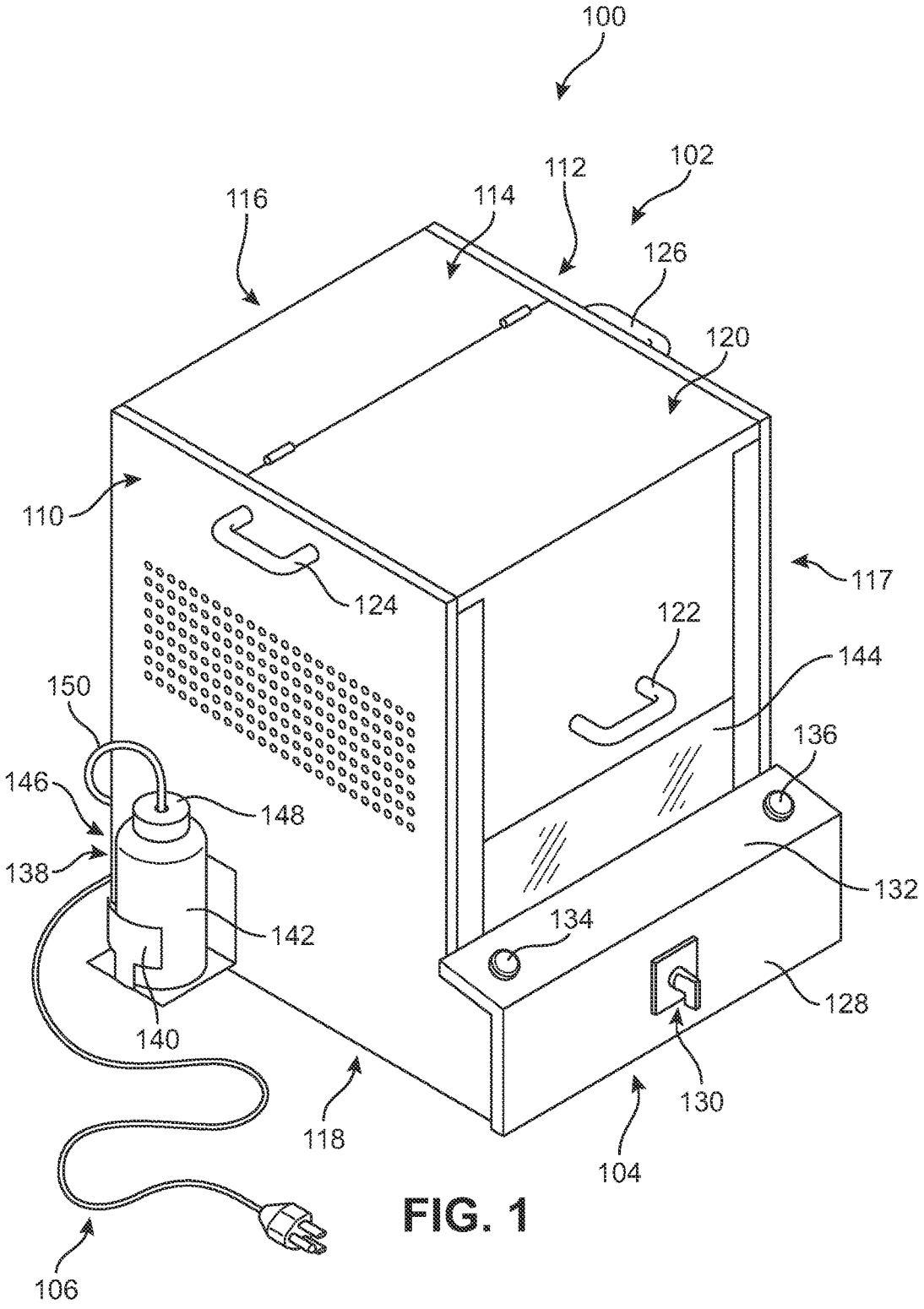
FIG. 1 is a schematic view of an embodiment of a steaming system in its closed configuration.

FIG. 1 is a schematic exterior view of an embodiment of a portable housing ("housing") 102 for a steaming system 100, including various components of steaming system 100 that are disposed within housing 102. The term "housing" as used throughout this detailed description and in the claims refers to any housing, enclosure, container or other structure that can be configured to store one or more devices, components and/or systems of a steaming system. Moreover, as used herein, "portable housing" refers to any housing, enclosure, container or other structure that may be moved from one location to another. Specifically, a portable housing may be any housing that is not required to be permanently secured to a ground surface in order for the steaming system to operate, is not attached to another building, or is capable of being displaced.

Some embodiments include provisions that allow the steaming system 100 to be easily moved or transported. In some cases, steaming system 100 is designed so that the entire system is self-contained and easily removed from its current location. Some embodiments can be miniaturized and sized so that one or two people are able to move steaming system 100 without requiring the use of a mechanical lift or truck, and may thus be man-portable. Furthermore, the housing may be of a weight configured to be moved by a person. For example, in some embodiments, the housing may comprise a weight between 0.5-45 kg. In other embodiments, the housing may weigh between 5-150 kg. The embodiment depicts housing 102 in the form of a tabletop structure. More specifically, housing 102 could be a structure that can be placed on a table or other raised areas, as well as a floor or ground area, and readily moved from one location to another. In some cases, housing 102 may include a structure that allows housing 102 to stand or be otherwise independently stable when placed on a surface (e.g., without additional supportive components or mounting elements). In other embodiments, housing 102 could be a permanently mounted structure.

The shape of housing 102 can vary in different embodiments. In some cases, housing 102 may have a substantially box-like shape. In other cases, housing 102 may have an approximately cuboid or rectangular prism shape. Examples of other shapes for housing 102 include, but are not limited to curved or rounded shapes, polygonal shapes, regular shapes, irregular shapes as well as any other kinds of shapes.

For purposes of reference, housing 102 may be divided into various portions. For example, in FIG. 1, housing 102 includes a first sidewall 110, a second sidewall 112, a rear wall 116, a front portion 117, a top portion 114, and a base portion 118. It can be seen that first sidewall 110, second sidewall 112, front portion 117, and rear wall 116 are joined or attached to base portion 118.

Front portion 117 may further comprise a chamber panel 144, which may in part enclose a heating chamber (not shown here). The heating chamber will be discussed in further detail with respect to FIGS. 7-9.

Steaming system 100 may include provisions for controlling or otherwise operating the various functions of steaming system 100, as well as determining the system's operational status. For example, in FIG. 1, front portion 117, extending along a generally vertical plane, is joined to an operation portion 104. Operation portion 104 may extend outward from front portion 117 of housing 102 in some embodiments. In FIG. 1, operation portion 104 also includes an upper panel 132 and a lower panel 128. Lower panel 128 may be oriented along a plane substantially parallel to that of front portion 117 in one embodiment. Lower panel 128 may include a switch 130. Furthermore, upper panel 132 may extend between and join front portion 117 to lower panel 128 in some embodiments. Upper panel 132 provides a surface that faces substantially upward, and includes an indicator 134 and a button 136. It should be understood that other embodiments, lower panel 128 and/or upper panel 132 may be configured or oriented differently from the embodiment depicted in FIG. 1. Switch 130, indicator 134, and button 136 will be discussed in further detail with respect to FIGS. 7-10.

Steaming system 100 may generate steam in some embodiments. For purposes of this description, steam is a term for the gaseous phase of water, which is formed when water is heated and/or pressurized. Thus, embodiments of steaming system 100 may include provisions for supplying water to steaming system 100. The water utilized may include distilled, purified, spring, tap water or other types of water. Water 146 is shown in FIG. 1 in a container 138 disposed in a receptacle 140 along first sidewall 110 of housing 102. In other embodiments, water 146 may be stored or supplied through other means or types of containers. In one embodiment, container 138 includes a bottle 142 and a cover 148, and is connected to a tube 150 which leads to an inlet (not shown) along rear wall 116. Thus, steaming system 100 may be readily supplied with water in most environments by filling (or re-filling) container 138 and sliding container 138 into receptacle 140. The water supply and its use will be discussed further with respect to FIGS. 8-9.

The embodiments described herein may also include provisions for supplying power to steaming system 100. A power cord 106 comprising a plug and cord may be included in some embodiments. In one embodiment, power cord 106 may be configured for use in a wide range of environments. Thus, power cord 106 may be connected to a standard AC power source or outlet (i.e., sockets) in some embodiments. In one embodiment, power cord 106 may connect with a 110 volt power supply. In another embodiment, power cord 106 may be configured for utilization with a range of voltages, including 110, 115, 120, 220, 230 or other standard residential voltages, and DC power. In some cases, power cord 106 may be adapted for industrial voltage use. Thus, steaming system 100 may be readily used in most of the locations where steaming system 100 may be transported or used.

In addition, housing 102 may include provisions for accessing an interior void (see FIG. 2) within housing 102. In some embodiments, housing 102 could include a door, a removable panel, or a lid. A lid may provide access to at least one interior compartment of housing 102. Of course, in other embodiments, other provisions for accessing the interior of housing 102 could be included.

In one embodiment, housing 102 includes a lid 120, as seen in FIG. 1. Lid 120 may comprise a substantially continuous material in some embodiments. Lid 120 may include various configurations for facilitating access to the interior of housing 102. The use and dimensions of lid 120 will be discussed in further detail with respect to FIG. 2-4.

As seen in FIG. 1, housing 102 may include provisions to facilitate the transport of housing 102 from one location to another. In some embodiments, housing 102 may include one or more handles. As used herein, the term "handle" refers to any device and/or component that allows the housing to be lifted, held, or otherwise carried by a person. Furthermore, a handle may also refer to a component that facilitates the opening and/or closing of a portion of housing. In the embodiment shown in FIG. 1, housing 102 includes a first handle 122, a second handle 124, and a third handle 126. In one embodiment, the handles are generally U-shaped, and mounted or otherwise attached to housing 102. In FIG. 1, first handle 122 is mounted on lid 120 of housing 102, second handle 124 is mounted to first sidewall 110, and third handle 126 is mounted to second sidewall 112. In FIG. 1, second handle 124 and third handle 126 may be used to help pick up or lift and/or carry steaming system 100. Handles may include other shapes or designs in other embodiments, including recesses or hand-sized grooves along housing 102, for example. In some embodiments, housing 102 may also additional or fewer handles, and/or other provisions for facilitating the carrying of housing 102. Other embodiments of housing 102 could utilize any other components or attachment features known in the art for carrying or holding objects.

The materials comprising the portions of housing 102 may vary in different embodiments. In some embodiments, one or more areas of housing 102 may include thermal or heat-insulating materials, such as fibrous insulations, glass, silica, rock wool, alumina silica, mineral wool, cellular insulations, elastomer, polyolefin, polyurethane, granular insulations, or other types of insulation material known in the art. Furthermore, components of steaming system 100, such as housing 102, operation portion 104, container 138, and other components, including components disposed in the interior of housing 102, may comprise other materials. Examples of different materials that could be used include, but are not limited to: metallic materials, polymer materials including plastics and/or rubbers, wooden materials, composite materials, steam resistant materials, plastic, glass, PVC, polypropelyne as well as any other kinds of materials.

Further detail on steaming system 100 is provided below, with respect to FIGS. 2-10. For purposes of convenience some components of steaming system 100 are not shown in the following figures. Thus, it should be understood that FIGS. 2-10 are for purposes of illustration only, and the components described above with respect to FIG. 1 may be included or referred to in the following description while not illustrated in the figures.

Figure 2:
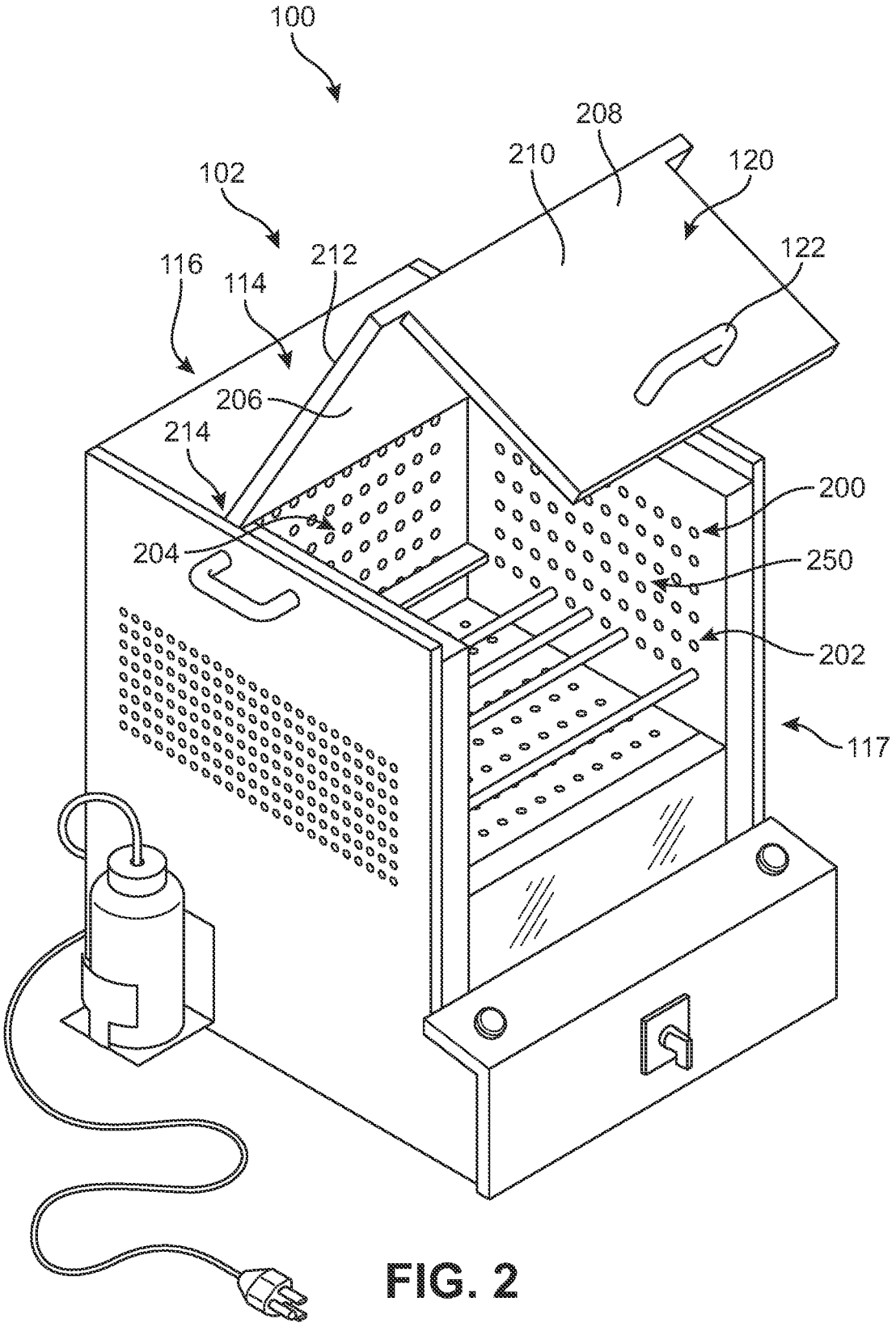
FIG. 2 is a schematic view of an embodiment of a steaming system as it is opened.
Figure 3:
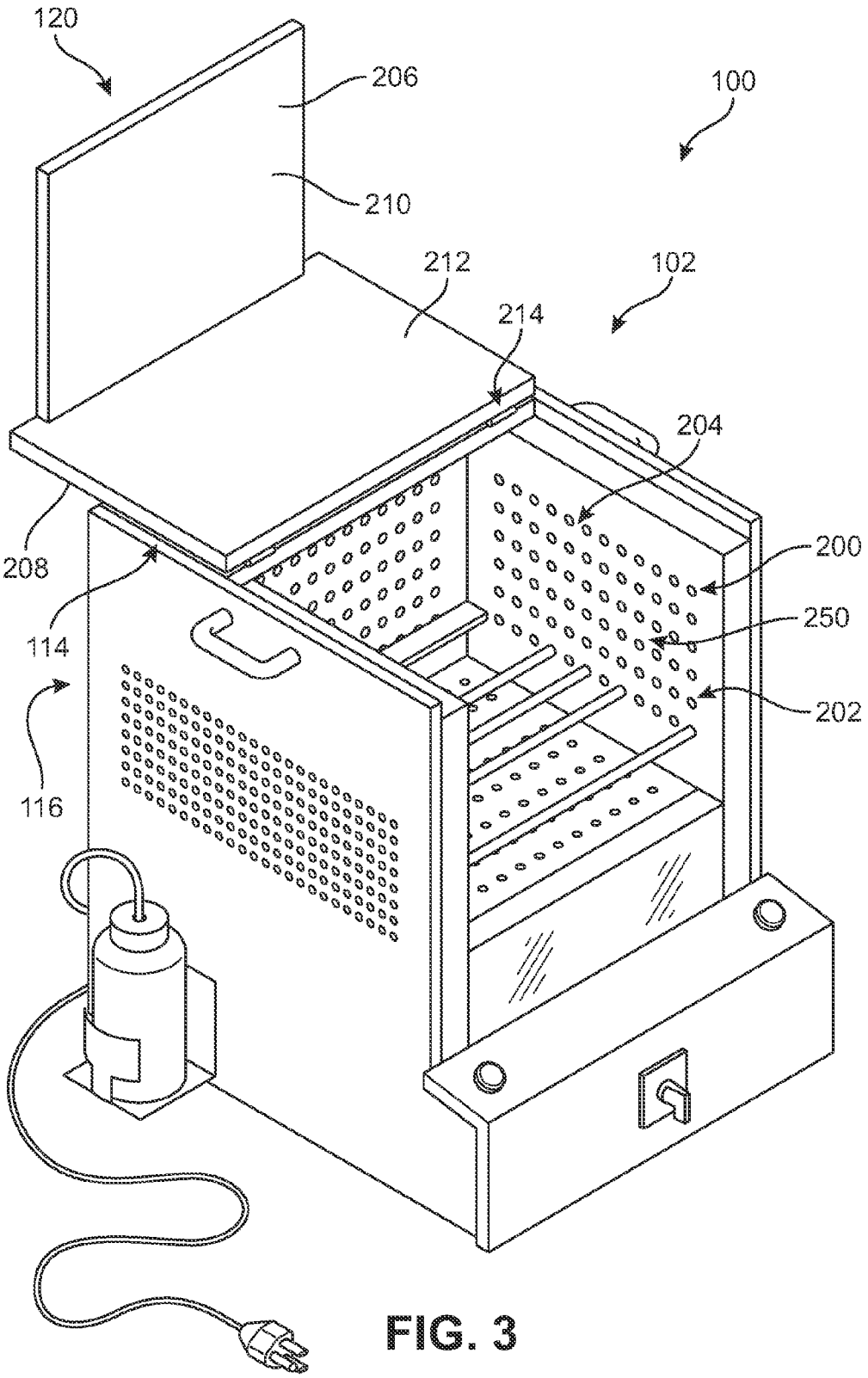
FIG. 3 is a schematic view of an embodiment of a steaming system in its open configuration.
Figure 4:
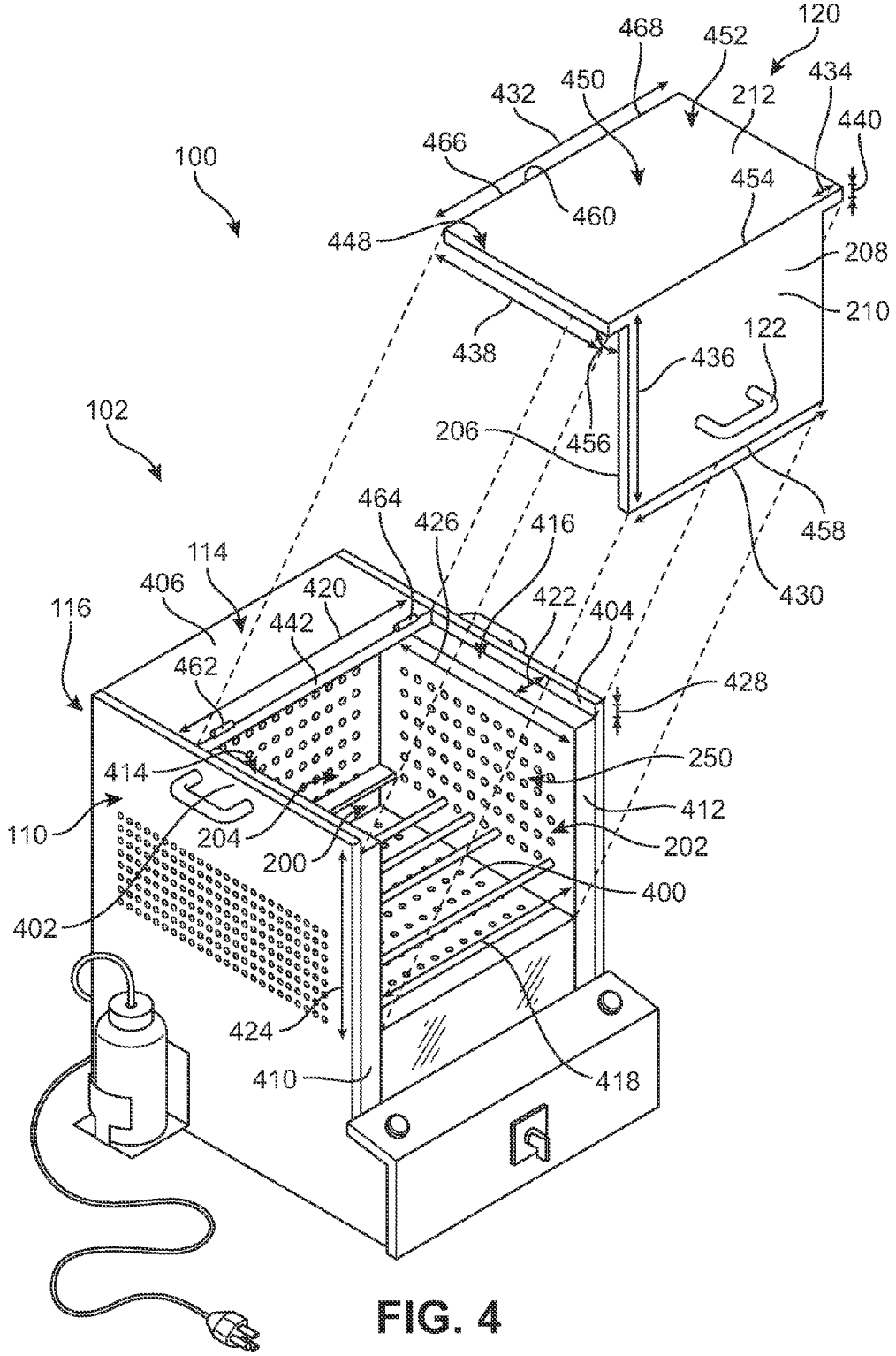
FIG. 4 is an exploded view of an embodiment of an interior of a housing for a steaming system.

FIGS. 2-4 illustrate a series of schematic views of an embodiment of lid 120 and its relationship to housing 102. FIG. 2 depicts lid 120 as it is partially raised upward. In some embodiments, first handle 122 may be used to lift lid 120. As lid 120 is raised, a portion of an interior void 200 including a steaming compartment 250 within housing 102 is exposed. In FIG. 2, a first opening 202 associated with front portion 117 is formed when lid 120 is raised. Furthermore, a second opening 204 associated with top portion 114 may also be formed when lid 120 is raised. In other words, there may be one opening along the front side of housing 102, as well as a second opening along the top surface of housing 102. However, it should be understood that first opening 202 and second opening 204 together comprise a single, continuous opening that can providing access to the interior of housing 102 in the embodiment of FIGS. 2-4. In one embodiment, first opening 202 is disposed along the plane associated with front portion 117 or the front wall of housing 102, and second opening 204 is disposed along the plane associated with the top portion 114 or the top surface of housing 102. Thus, in different embodiments, there may be openings oriented along various sides or surfaces of housing 102 when lid 120 is raised.

For purposes of reference, lid 120 may be divided into various portions. For example, lid 120 can be seen to include an exterior surface 208 and an interior surface 206 in FIG. 2. Exterior surface 208 refers to the surface of lid 120 that is external when housing 102 is in its closed configuration (as shown in FIG. 1). Interior surface 206 refers to the surface of lid 120 that faces and helps to define interior void 200 when housing 102 is in the closed configuration (as shown in FIG. 1). Furthermore, lid 120 includes a first wall 210 and a second wall 212. Second wall 212 of lid 120 is joined to top portion 114 along a hinge portion 214.

In some embodiments, as lid 120 is raised, lid 120 moves or swings around hinge portion 214. In one embodiment, lid 120 swings upward and in the direction of rear wall 116 of housing 102, as further shown in FIG. 3. Second wall 212 may come to rest at least partially upon a portion of top portion 114 in other embodiments. In FIG. 3, a substantial area of exterior surface 208 of second wall 212 contacts top portion 114. In one embodiment, lid 120 is able to fold and rest upon top portion 114 in the open configuration of housing 102. In other words, top portion 114 may provide a convenient holding platform for second wall 212 of lid 120 to rest in some embodiments.

Thus, in one embodiment, lid 120 may swing around hinge portion approximately 180 degrees. However, in other cases, hinge portion 214 may also partially restrict the movement of lid 120, such that lid 120 may move only partway toward rear wall 116 as it is raised. In some cases, lid 120 may rotate about hinge portion 214 less than 180 degrees. In one case, hinge portion 214 may include a holding mechanism to temporarily lock lid 120 into place as housing 102 is in its open configuration.

In FIG. 4, an exploded isometric view of an embodiment of steaming system 100 is depicted. Lid 120 has been removed from the remainder of housing 102 to expose steaming compartment 250. It can be seen that in the open configuration, steaming compartment 250 is generally bounded by rear wall 116, an upper portion 402 of first sidewall 110, an upper portion 404 of second sidewall 112, a rear portion 406 of top portion 114 (i.e., the portion of top portion 114 remaining when lid 120 is removed from housing 102) and a perforated plate 400. Steaming compartment 250 is further bounded by a first inner sidewall 410 and a second inner sidewall 412. First inner sidewall 410 is disposed adjacent first sidewall 110, and second inner sidewall 412 is disposed adjacent to second sidewall 112.

In some embodiments, first inner sidewall 410 and second inner sidewall 412 have substantially similar maximum heights, as shown in FIG. 4. However, in other embodiments, the heights of first inner sidewall 410 and second inner sidewall 412 may differ. Furthermore, it can be seen that the height of first inner sidewall 410 is less than the height of first sidewall 110, such that a first recess 414 is formed along the inner perimeter of first sidewall 110, adjacent second opening 204. Similarly, the height of second inner sidewall 412 is less than the height of second sidewall 112, forming a second recess 416 along the inner perimeter of second sidewall 112 adjacent first opening 202. The difference in heights between each sidewall and its corresponding inner sidewall (i.e., the thickness of the recess) may range between 0.5-25 centimeters in some embodiments. In other embodiments, the difference may be smaller or greater.

In one embodiment, partly as a result of first recess 414 and second recess 416, steaming compartment 250 can be seen to include a generally three-dimensional "T" shape, as seen in FIG. 4. In other embodiments, steaming compartment 250 may have any other shape, including a box-like shape, a rectangular prism, or other regular or irregular shapes.

For purposes of reference, some of the dimensions of steaming compartment 250 are identified in FIG. 4. Steaming compartment 250 can include a first width 418 extending between first inner sidewall 410 and second inner sidewall 412, a second width 420 extending between first sidewall 110 and second sidewall 112, and a third width 422 representing the width of second inner sidewall 412. It should be understood that the width of first inner sidewall 410 may be substantially similar to that of second inner sidewall 412 in some embodiments. However, in other embodiments, the widths may differ.

Furthermore, steaming compartment 250 may include a first length 424 extending between perforated plate 400 and second opening 204, a second length 426 extending between first opening 202 and an inner edge 442 of rear portion 406, and a third length 428 representing the difference in height between second sidewall 112 and second inner sidewall 412. It should be understood that the difference in height between first sidewall 110 and first inner sidewall 410 may be substantially similar to that of third length 428 in some embodiments. However, in other embodiments, the lengths may differ.

Steaming system 100 may include provisions for sealing or otherwise enclosing steaming compartment 250. In some embodiments, lid 120 may provide a means of fully covering steaming compartment 250 and facilitating the closed configuration as shown in FIG. 1. In one embodiment, as lid 120 is lowered into the remainder of housing 102, lid 120 may be substantially level or even with the outer surface of housing 102, such that the majority of housing 102 provides a substantially smooth outer surface.

Lid 120 may be divided into various portions for purposes of convenience. In FIG. 4, lid 120 includes first wall 210 and second wall 212. First wall 210 may have an inner edge that is joined to an inner edge of second wall 212, forming a first angle 456 associated with interior surface 206 of a joined inner edge 454 of lid 120. In some embodiments, first angle 456 may be near or equal to 90 degrees. However, in other embodiments, first angle 456 may be substantially less than 90 degrees, or substantially greater than 90 degrees. Thus, first wall 210 and second wall 212 together may form a continuous bent region in lid 120. In one embodiment, first wall 210 and second wall 212 may form a substantially "L" shaped lid. In addition, first handle 122 may be disposed along exterior surface 208 of first wall 210.

Furthermore, second wall 212 may include a first ledge 448, a second ledge 452, and an intermediate portion 450 disposed between first ledge 448 and second ledge 452. In one embodiment, first ledge 448 may extend outward in the horizontal plane further than first wall 210 extends in the vertical plane, which allows a portion of second wall 212 to include an overhang (i.e., first ledge 448). Second ledge 452 may also extend outward in the opposite direction, forming a substantially similar overhang.

For purposes of reference, some of the dimensions of lid 120 are also identified in FIG. 4. For example, lid 120 can be seen to include a fourth width 430 extending along an outer edge 458 of first wall 210, a fifth width 432 extending along an outer edge 460 of second wall 212, and a sixth width 434 representing the width of second ledge 452. It should be understood that the width of first ledge 448 may be substantially similar to that of second ledge 452 in some embodiments. However, in other embodiments, the widths may differ.

Furthermore, lid 120 may include a fourth length 436 representing the height of first wall 210, a fifth length 438 representing the length of first ledge 448, and a sixth length 440 representing the thickness of second ledge 452. It should be understood that the length of first ledge 448 may be substantially similar to the length of second ledge 452. However, in other embodiments, the lengths may differ. In addition, it should be understood that the thickness of second ledge 452 may be substantially similar to the thickness of first ledge 448 in some embodiments. However, in other embodiments, the thicknesses may differ. Thickness may also vary depending on the degree of insulation desired in lid 120.

In different embodiments, lid 120 may be joined to a portion of housing 102 to provide an enclosure to steaming system 100. Thus, in one embodiment, dimensions of lid 120 may be configured to match or correspond with the dimensions of housing 102 as described above. For example, first width 418 may be substantially similar to fourth width 430, second width 420 may be substantially similar to fifth width 432, and third width 422 may be substantially similar to sixth width 434 in one embodiment. Furthermore, first length 424 may be substantially similar to fourth length 436, second length 426 may be substantially similar to fifth length 438, and third length 428 may be substantially similar to sixth length 440 in some embodiments.

Thus, lid 120 may be configured to provide a substantially seamless, smooth, or continuous piece that fits snugly into the contours formed in housing 102. In other words, housing 102 may include contours that readily receive the shape of lid 120, and allow housing 102 to form an enclosed environment or chamber when lid 120 is fully lowered and steaming system 100 is in the closed configuration. For example, in one embodiment, first recess 414 and/or second recess 416 may be configured to provide a kind of shelf or groove to receive either first ledge 448 and second ledge 452. In another example, inner edge 442 of rear portion 406 may be disposed such that it is directly adjacent to outer edge 460 of second wall 212.

In some embodiments, steaming system 100 may be configured to facilitate movement of lid 120 relative to housing 102. Lid 120 may be joined to various portions of housing 102. For example, lid 120 may be joined to top portion 114 in various ways, allowing rotation of lid 120 relative to rear portion 406. In one embodiment, the hinge portion (described earlier with respect to FIG. 2) may include one or more hinge parts, including but not limited to a sectional barrel and pivot, or a pivot hinge. For example, in FIG. 4, there is a first hinge part 462 and a second hinge part 464, disposed proximate to inner edge 442 of rear portion 406. Furthermore, outer edge 460 of second wall 212 may include a third hinge part and a fourth hinge part. Due to the perspective of FIG. 4, the third hinge part and the fourth hinge part are not shown. However, possible locations for third hinge part and fourth hinge part are referred to in the figures along a third hinge area 466 and a fourth hinge area 468. In some embodiments, first hinge part 462 may contact and join with a third hinge part. Similarly, in some embodiments, second hinge part 464 may contact and join with a fourth hinge part. In other embodiments, there may be fewer or greater hinge parts comprising the hinge portion.

In addition, it should be understood that lid 120 may be joined to other portions of housing 102, such as first sidewall 110, second sidewall 112, and/or base portion 118, or other portions. Thus, in some embodiments, lid 120 may rotate along directions different from the example shown in FIG. 4. In one embodiment, for example, lid 120 may allow housing 102 to open along a lateral direction, while in another embodiment, lid 120 may be opened downward (e.g., in a similar manner to a conventional domestic oven). Furthermore, lid 120 may be segmented into distinct sections whereby lid 120 may be hinged along multiple portions. Thus, in some cases, different parts of lid 120 may be used to form different openings in housing 102, depending on the user's preferences.

Figure 5:
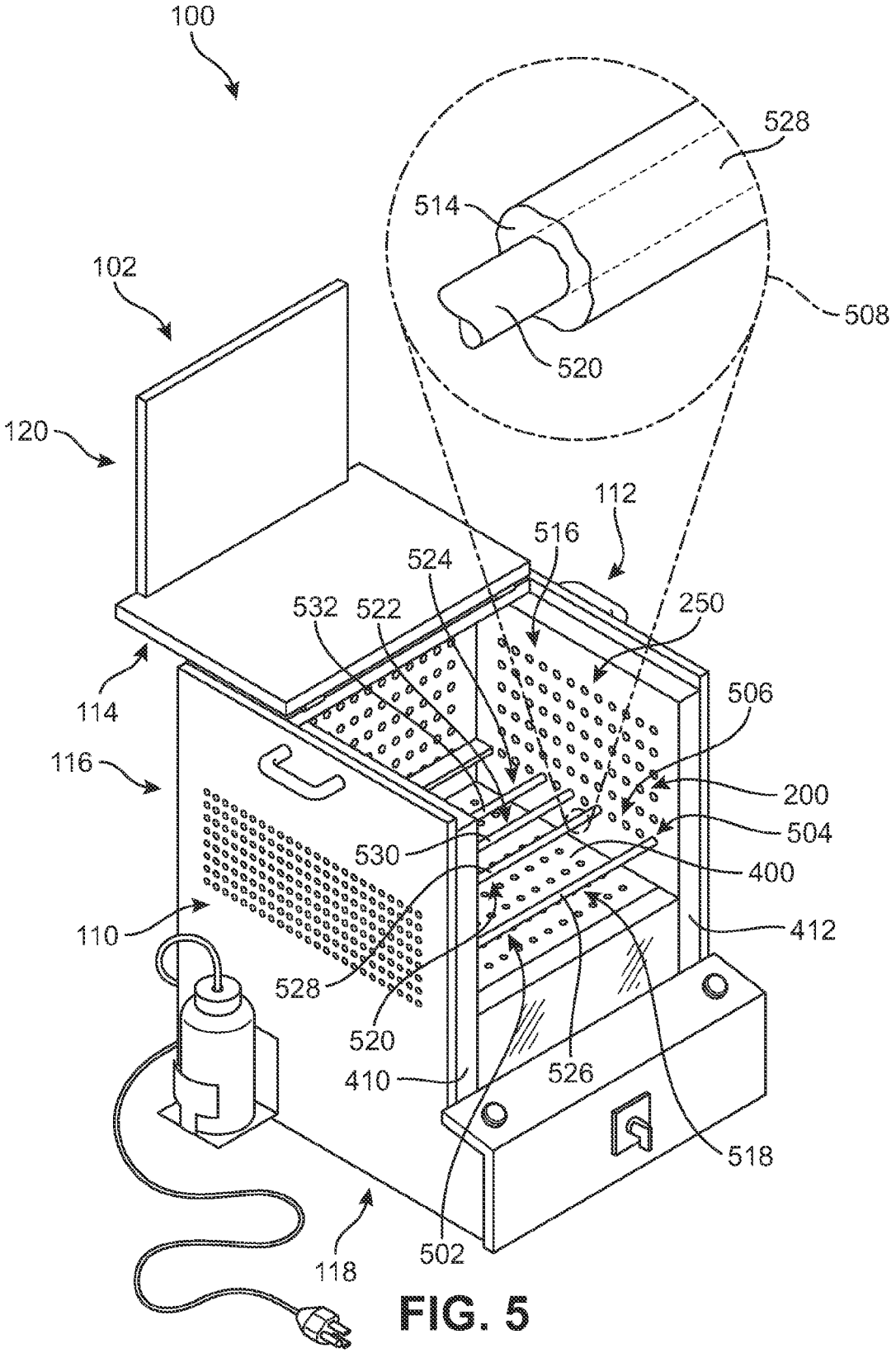
FIG. 5 is a schematic view of an embodiment of an interior of a housing for a steaming system.
Figure 6:
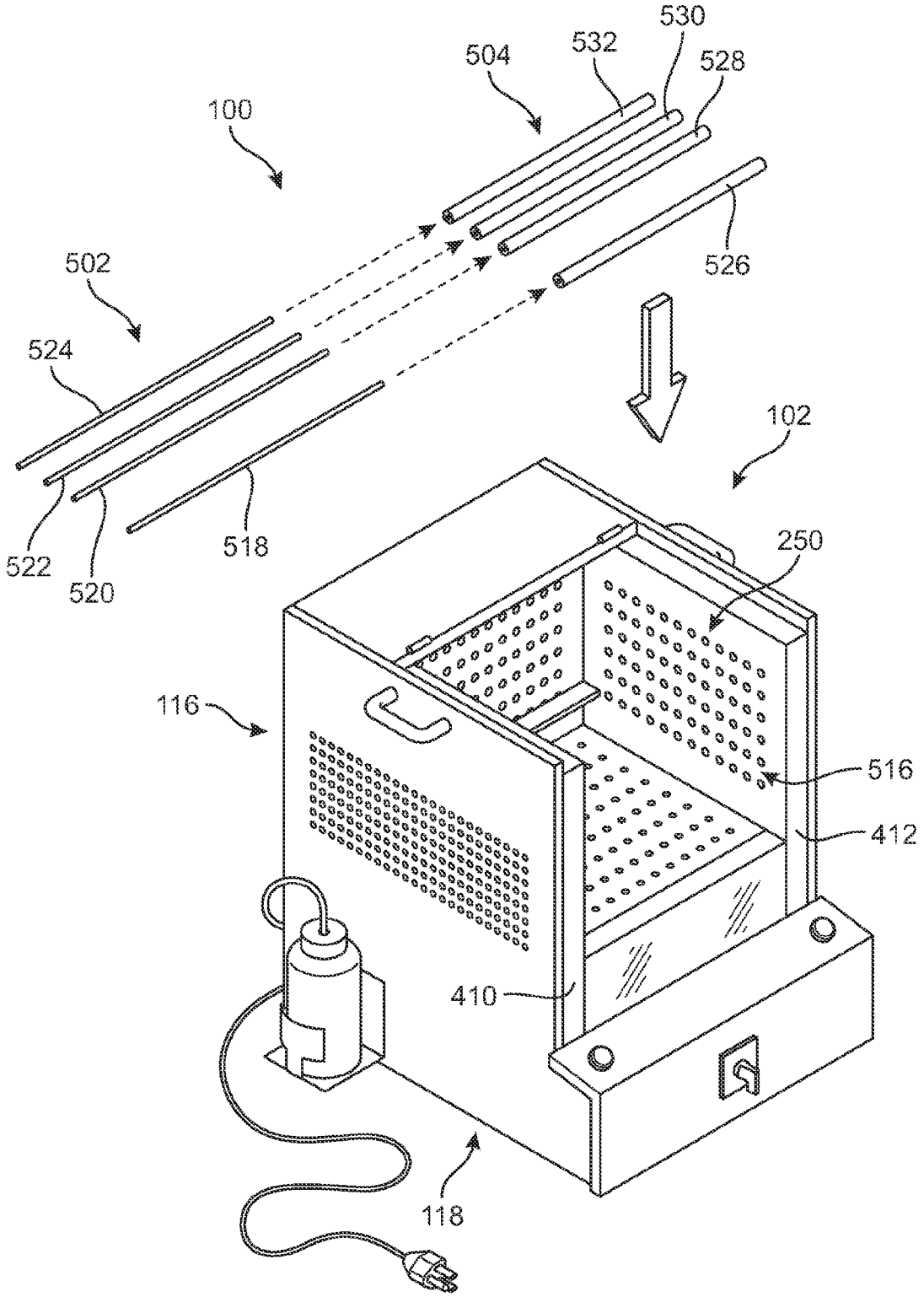
FIG. 6 is an exploded view of an embodiment of an interior of a housing for a steaming system.

FIGS. 5-6 illustrate a schematic interior view of housing 102, including various components of steaming system 100 that are disposed within housing 102. Referring now to FIG. 5, housing 102 includes interior void 200 with steaming compartment 250. Various components of steaming system 100 may be disposed within steaming compartment 250. Along the interior of steaming compartment 250, there may be features that provide ventilation within steaming system 100. For example, there may be a plurality of apertures 516 formed along one or more walls bounding steaming compartment 250. In FIGS. 5 and 6, apertures 516 are included along first inner sidewall 410 and second inner sidewall 412, as well as rear wall 116. In FIGS. 5 and 6, apertures 516 are disposed in a regular repeating pattern of rows and columns, and are generally the same size and comprise a round shape. However, it should be understood that in other embodiments, apertures 516 may be configured in any arrangement, and may differ from the shape and size depicted herein. Apertures 516 may help provide steaming system 100 with a means of allowing the controlled or regulated escape of molecules of steam during operation, or to provide a means of air circulation in some embodiments. In other embodiments, apertures 516 may facilitate the return of steaming system 100 from a higher pressure to atmospheric pressure.

Furthermore, in one embodiment, steaming compartment 250 includes a plurality of rails 502. It should be understood that rails 502 as illustrated in FIG. 5 are enclosed within a plurality of sleeves 504 (discussed further below), and rails 502 are thus referred to in FIG. 5 by their general location. However, FIG. 6 provides a view of rails 502 as separated from sleeves 504.

As shown in the figures, rails 502 may extend or be disposed between first inner sidewall 410 and second inner sidewall 412. In some embodiments, rails 502 may provide a series of raised surfaces within steaming compartment 250. In one embodiment, rails 502 may be placed in steaming compartment 250 such that they are substantially disposed in the same horizontal plane and form a kind of framework or shelf to receive and support articles or objects. Rails 502 may provide a stable stowing surface for placement of articles (i.e., similar to a rack). Furthermore, the design and placement of rails 502 may allow steam to readily rise through a plurality of gaps 506 extending between rails 502, which can facilitate the contact between steam and an article.

The shape of rails 502 can differ from one embodiment to another. For example, in some embodiments, rails 502 may be rounded or curved, similar to longitudinal bars or rods. However, in other embodiments, rails 502 may comprise a substantially flat or two-dimensional material or structure. The term "two-dimensional" as used through this detailed description and in the claims refers to any generally flat material exhibiting a length and width that are substantially greater than a thickness of the material. Although two-dimensional materials may have smooth or generally untextured surfaces, some two-dimensional materials will exhibit textures or other surface characteristics, such as dimpling, protrusions, ribs, or various patterns, for example. In some embodiments, the use of rails 502 can provide a secure framework for receiving different articles, whether the rails are flat or curved.

The materials comprising rails 502 may vary in different embodiments. In one embodiment, rails 502 may not conduct heat, or may conduct relatively little heat. Additionally, in some embodiments, steaming compartment 250 may include provisions for protecting rails 502 and further, shielding of rails 502 as they are exposed to heat. In one embodiment, steaming compartment 250 may include one or more sleeves 504. Sleeves 504 may be disposed over one or more rails 502 in one embodiment. In other embodiments, a sleeve may surround or enclose at least a portion of a rail. In one embodiment, sleeves 504 may resemble substantially hollow tubes or tubular structures. For example, as shown in magnified area 508, a second sleeve 528 surrounds a portion of a second rail 520. Second rail 520 is substantially cylindrical in FIG. 5, and has a round cross-sectional shape. In other embodiments, second rail 520 may include other cross-sectional shapes, including oval, square, rectangular, or other regular or irregular shapes. The diameter of second rail 520 is less than the diameter of second sleeve 528 in FIG. 5. The size of second rail 520 may be increased or decreased to provide an improved fit within second sleeve 528 in one embodiment. Similarly, in another embodiment, the size of second sleeve 528 may be increased or decreased to provide an improved fit with second rail 520. Furthermore, a thickness 514 of second sleeve 528 may be varied (increased or decreased) in different embodiments, for example to increase or decrease the amount of insulation of rails 502.

Steaming compartment 250 may include no rails, one rail, or multiple rails. Furthermore, there may be no sleeves, one sleeve, there may be one sleeve for each rail, or there may be shorter sleeves that cover only a portion of the rails. In FIG. 5, a first sleeve 526, second sleeve 528, a third sleeve 530, and a fourth sleeve 532 are shown. Within each sleeve, steaming compartment 250 includes a first rail 518, second rail 520, a third rail 522, and a fourth rail 524.

Sleeves 504 may facilitate the ease with which a user engages with steaming system 100. For example, sleeves 504 may provide additional insulation within steaming compartment 250, whereby a user may more readily interact with components such as rails 502. In addition, sleeves 504 may maintain rails 502 in a cleaner environment, and extend the life of rails 502. In some embodiments, sleeves 504 may keep dirt and other particles from contacting rails 502.

Sleeves 504 may be made of various generally flexible or inflexible materials. For example, sleeves 504 can comprise a silicone rubber insulation, natural rubber or other type of synthetic or plastic insulation coating. In some embodiments, materials comprising sleeves 504 may be substantially water-proof, water-resistant, and/or substantially impermeable to steam and other gas or fluids.

In FIG. 6, an exploded view of steaming compartment 250 of housing 102 (with the lid removed) is depicted. As shown in FIG. 6, rails 502 may be removable in different embodiments. In addition, sleeves 504 may be removable in some embodiments. In other words, rails 502 may be pulled out of steaming compartment 250, and sleeves 504 may be pulled off, slid away, or otherwise separated from rails 502. In some cases, sleeves 504 and/or rails 502 may be configured for easy removal. For example, sleeves 504 and/or rails 502 may include sliding portions, flexible segments, or moveable pieces. Thus, rails 502 may be easily cleaned and/or replaced when needed. In FIG. 6, first sleeve 526, second sleeve 528, third sleeve 530, and fourth sleeve 532 are shown removed from rails 502. Rails 502, including first rail 518, second rail 520, third rail 522, and fourth rail 524, are shown removed from housing 102. In some embodiments, each rail may be easily removed and replaced. Thus, in some embodiments, various components of steaming system 100 can be readily cleaned, updated, or replaced by a user. In addition, each sleeve may be quickly removed from a rail, and if desired, a new rail may be inserted into the same sleeve. Similarly, sleeves 504 may over time be cleaned, modified, and/or replaced in some embodiments. Sleeves 504 may be replaced at a lower cost than other components, and may also be customized in various colors or designs for the user's preferences in different embodiments.

Rails 502 may be mounted within steaming compartment 250 in various ways. In some embodiments, rails 502 may be mechanically attached or joined to first inner sidewall 410 and second inner sidewall 412. In one embodiment, there may be one or more holes, sockets, recesses, or grooves along parts of first inner sidewall 410 and second inner sidewall 412 that are configured to receive and/or help secure each end of rails 502. In another embodiment, rails 502 may be configured to fit into apertures 516 (as described above). Thus, rails 502 may include a cross-sectional shape and/or size substantially similar to or smaller than that of apertures 516.

The inclusion of rails 502 and sleeves 504 as described above can thus facilitate the use and care of steaming system 100 by a layperson by simplifying the set-up process. Furthermore, these features may decrease overall maintenance costs. In addition, in embodiments where rails 502 may be removed and/or reinserted, a user may be able to insert or engage rails 502 to different mounting sockets or apertures 516, such that rails 502 are disposed in various locations within steaming compartment 250. In another embodiment, depending for example on the articles to be used with steaming system 100, rails 502 may be moved closer together or farther apart to accommodate the particular size and shape of the articles. Furthermore, in some cases, a greater number of rails 502 may be mounted, while in other cases, fewer rails 502 may be mounted.

In different embodiments, steaming system 100 may include provisions for regulating pressure in interior void 200. For example, in one embodiment, there may be a compressor (not shown in figures) included in steaming system 100. In one embodiment, there may be a compressor disposed near rear wall 116 or base portion 118. In some embodiments, the use of a compressor may facilitate the removal of vapor clouds as well as help control pressure, without the need for an additional electrical supply. Furthermore, a compressor may be used to save energy by recovering at least some of the steam vapor from steaming compartment 250 and feeding the steam vapor back into steaming system 100 for heating. In other embodiments, such provisions may help equalize temperature throughout steaming compartment 250.

Figure 7:
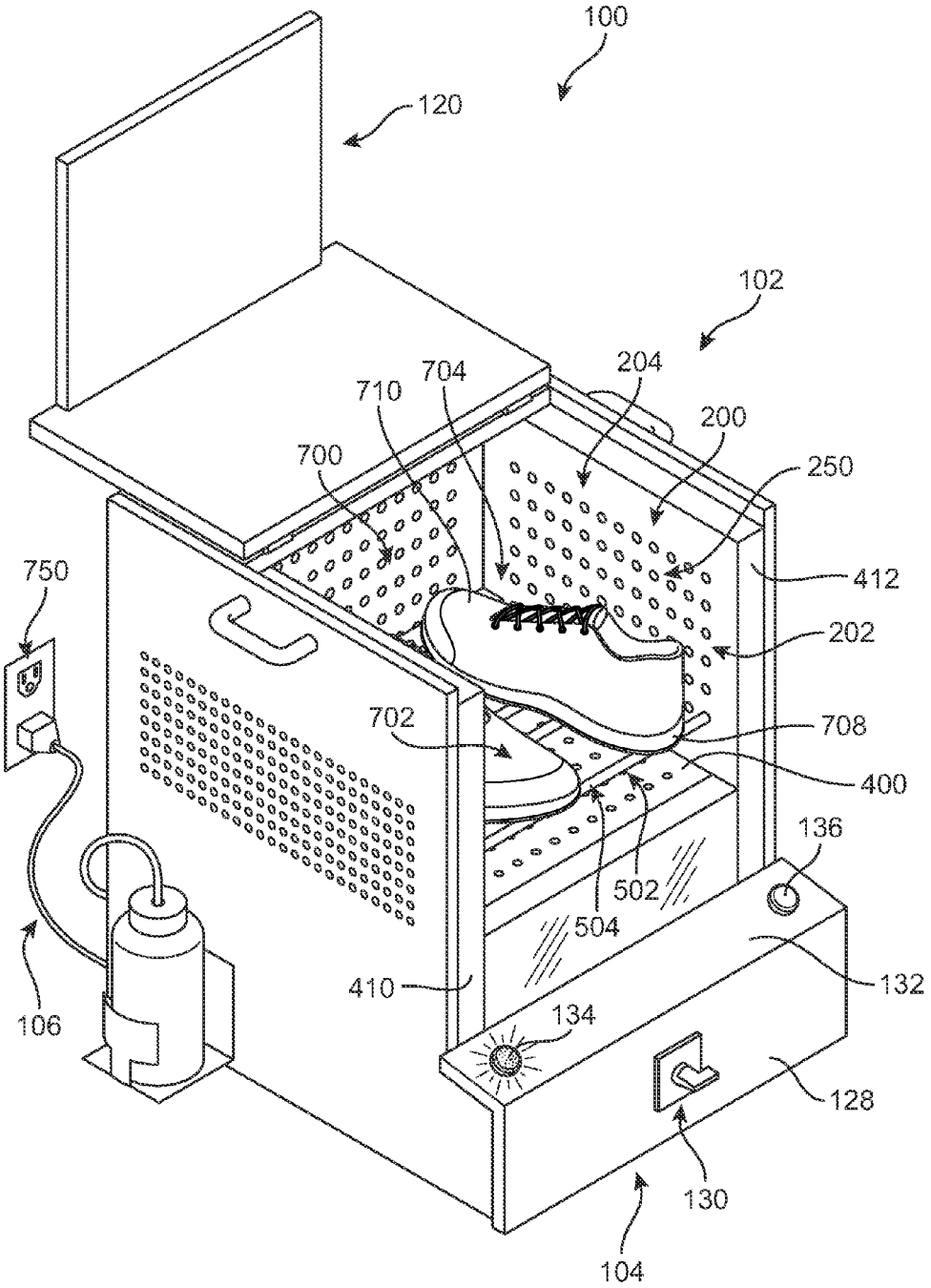
FIG. 7 is a schematic view of an embodiment of an interior of a housing for a steaming system with a pair of articles of footwear.

FIGS. 7-10 illustrate a series of schematic views of an embodiment of the operation of steaming system 100. Initially, housing 102 may be disposed in the open configuration, such that lid 120 is lifted upward, exposing a portion of steaming compartment 250. In FIG. 7, a pair of articles ("articles") 700 comprising a first article 702 and a second article 704 have been placed within steaming compartment 250. In the embodiments illustrated herein, articles 700 refer to a pair of footwear. However, the term "articles" is intended to include both articles of footwear (e.g., shoes) and articles of apparel (e.g., shirts and pants), as well as various other objects. While the disclosed embodiments are described in the context of footwear, the disclosed embodiments may further be equally applied to any article of apparel, clothing equipment, or other objects. For example, the disclosed embodiments may be applied to hats, caps, shirts, jerseys, jackets, socks, shorts, pants, undergarments, athletic support garments, gloves, wrist/arm bands, sleeves, headbands, any knit material, any woven material, any nonwoven material, sports equipment, etc. Thus, as used throughout this disclosure, the term "article of apparel" may refer to any apparel or clothing, including any article of footwear, as well as hats, caps, shirts, jerseys, jackets, socks, shorts, pants, undergarments, athletic support garments, gloves, wrist/arm bands, sleeves, headbands, any knit material, any woven material, any nonwoven material, etc.

Thus, it should be understood that steaming system 100 may be configured or otherwise dimensioned for use with a wide variety of articles. In other words, the dimensions and/or arrangement of various portions of steaming system 100 can be configured for use with any type of apparel. For example, in some embodiments, steaming system 100 may be configured for use with different kinds of garments or other apparel. In different embodiments, steaming system 100 may be utilized with products, articles, or objects disclosed in any of the following documents: Glass, U.S. Patent Publication Number 2012/0090068, published Apr. 19, 2012 and titled "User-Moldable Sports Equipment Using Heated Water Bath," this application being hereby incorporated by reference in its entirety; Baumgartner, U.S. Patent Publication Number 2008/0249446, published Oct. 9, 2008, and titled "Low-Temperature Reusable Thermoplastic Splint," this application being hereby incorporated by reference in its entirety; Huybrechts, U.S. Pat. No. 5,548,848, issued Aug. 27, 1996, and titled "Mouldable Composition and Method of Making It," this application being hereby incorporated by reference in its entirety; Jacobs, U.S. Pat. No. 5,405,312, issued Apr. 11, 1995, and titled "Custom Fit Body Guards," this application being hereby incorporated by reference in its entirety; Cox, U.S. Pat. No. 5,074,292, issued Dec. 24, 1991, and titled "Conformable Brace and Method of Application," this application being hereby incorporated by reference in its entirety; McNamee, U.S. Pat. Publication No. 2012/0180190, published Jul. 19, 2012, and titled "Glove With Thermally Moldable Shaping Inserts," this application being hereby incorporated by reference in its entirety; Dua, U.S. Patent Publication No. 2010/0199406, published Aug. 12, 2010, and titled "Thermoplastic Non-Woven Textile Elements," this application being hereby incorporated by reference in its entirety; and Dua, U.S. Patent Publication No. 2012/0227282, published Sep. 13, 2012, and titled "Layered Thermoplastic Non-Woven Textile Elements," this application being hereby incorporated by reference in its entirety. Embodiments of the present disclosure can make use of any of the systems, components, devices and methods disclosed in the above referenced applications.

Furthermore, articles 700 can be configured with one or more customizable portions. The term "customizable portion" as used throughout this detailed description refers to a portion with characteristics that can be customized. Examples of such characteristics include, but are not limited to, size, shape, material properties (such as rigidity and/or flexibility) as well as other properties. In one embodiment, a customizable portion may be a portion with a size and/or shape that can be adjusted. In addition, in some cases, the material properties of a customizable portion could also be adjusted.

The characteristics of customizable portions can be varied in different ways. In some embodiments, a customizable portion can be varied through a curing process. In other words, the customizable portion may be heated above a predetermined temperature and modified before cooling the customizable portion so that the modifications are retained. In other embodiments, the characteristics of customizable portions can be varied through the use of pressure, chemical additives or other known methods of changing the characteristics of material including the size, shape, rigidity, flexibility and/or other properties. In still other embodiments, a combination of heat, pressure and/or chemicals could be used to modify the customizable portion.

Generally, articles 700 can comprise one or more customizable portions. In some embodiments, a sole structure 708 may be associated with one or more customizable portions. In other embodiments, an upper 710 may be associated with one or more customizable portions. In other cases, a customizable portion may be associated with any combination of different portions of upper 710 and sole structure 708 or other portions of articles 700. In particular, the customizable portions may extend through a substantial majority of upper 710 and/or an insole (not shown). Using this arrangement, articles 700 may be custom shaped to the specific geometry of the foot of a user to enhance comfort and fit.

In order to modify any customizable portions, articles 700 may be heated above a predetermined temperature. For example, in embodiments where a customizable portion may transition between a crystalline phase and a liquid like phase, the predetermined temperature can be a glass transition temperature. In some cases, the glass transition temperature is useful in characterizing amorphous solids such as plastics or similar materials that may not have a true melting point. However, in other cases, the predetermined temperature can be some other temperature at which a customizable portion may become substantially more deformable. In some cases, articles 700 may be placed in an oven. In other cases, articles 700 may be heated using steam. In one embodiment, articles 700 may be heated in any steam environment. A steam environment can be created in different ways. In some cases, a steam environment can be created using steaming system 100. Thus, by selecting materials for articles 700 that become substantially more deformable at temperatures less than or equal to the temperature of steam, a customizable portion can be activated by applying steam to an article of footwear.

In different embodiments, articles 700 can be disposed in any arrangement or orientation within steaming compartment 250. Articles 700 are supported by rails 502 (encased in sleeves 504) in one embodiment, and can be disposed in any orientation desired. Thus, articles 700 may be placed such that they are disposed in a horizontal or vertical direction, or disposed at an angle (such as tilted diagonally). However, in other embodiments, articles 700 may be placed on their sides (e.g., where upper 710 contacts sleeves 504), or where sole structure 708 is facing upward and/or the collar or throat is facing downward. In one embodiment, articles 700 are placed such that the bottom side of each sole structure 708 faces downward, toward perforated plate 400. Furthermore, multiple articles 700 may be disposed such that they each face different directions in some embodiments, or they may be aligned in similar orientations within steaming compartment 250.

In embodiments where articles 700 comprise a pair of footwear, a range of footwear sizes may be used within steaming system 100. For example, in some embodiments, steaming compartment 250 may be large enough to accommodate footwear between standard US shoe sizes 0-17. In another embodiment, steaming system 100 may be used with footwear greater than a US size 17.

In order to supply power to steaming system 100, the system may include power switch 130. In some embodiments, power switch 130 may comprise a single knob which can be turned or rotated to switch the system on. In one embodiment, power switch 130 may be an isolated knob located along lower panel 128 of operation portion 104. Thus, in one embodiment, power switch 130 may provide an easy to locate knob, as well as a feature that is generally easy to use, where the knob is simply turned in order to shift from an OFF position to an ON position. The design of power switch 130 may also provide protection from accidental tampering (e.g., by accidentally bumping into operation portion 104) due to the inclusion of a rotational switch. In other embodiments, power switch 130 may include various settings and configurations, including but not limited to power level, temperature, or steam intensity. Power cord 106 may be plugged into a power outlet 750, as described further below with reference to FIG. 8.

Furthermore, steaming system 100 can include provisions for displaying the status of the system to a user. For example, in FIG. 7, power switch 130 has been turned to an ON position. When steaming system 100 is turned on, a light may glow or turn on within indicator 134 (along upper panel 132) in some embodiments. The light associated with indicator 134 may turn off when the system is turned off or unplugged. Thus, a user may readily ascertain whether steaming system 100 is ready for use.

Figure 8:
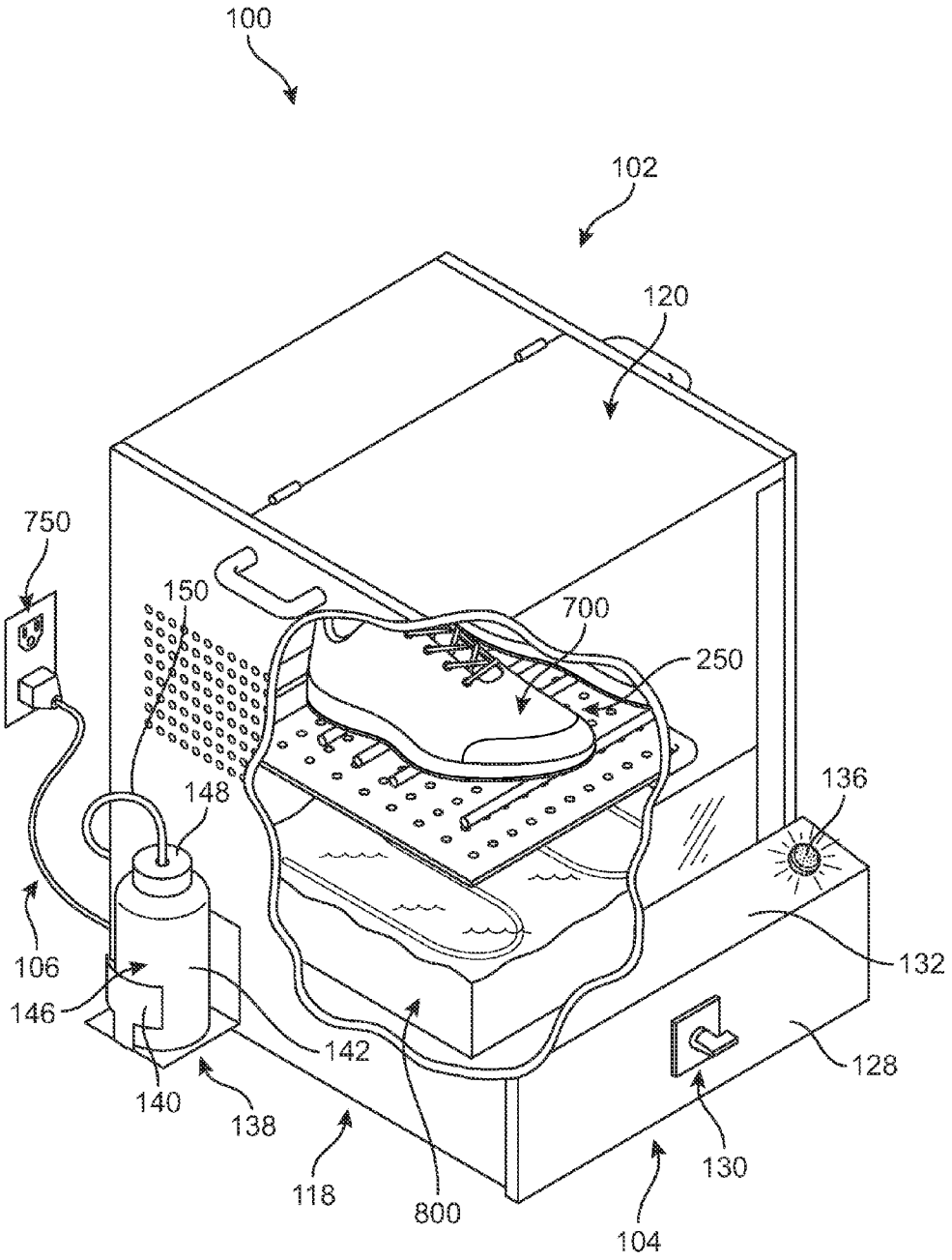
FIG. 8 is a cut-away view of an embodiment of an interior of a housing for a steaming system with a pair of articles of footwear.

Once articles 700 have been placed within steaming system 100, lid 120 may be lowered and closed, and the steaming of articles 700 may commence in one embodiment, as shown in FIG. 8. In some embodiments, steaming system 100 may include provisions for starting the steaming process. In one embodiment, there may be a START button or switch. In other embodiments, there may be a timer which can be set to start the process after a selected duration of time. In the embodiment of FIG. 8, button 136 may be used to start the steaming process. Button 136 may be a press-button, which is pressed once to start the steaming cycle. In other embodiments, a different mechanism may be used. Thus, the operation of steaming system 100 may be generally simple and efficient. After button 136 has been turned to START, button 136 may light up to display the status of steaming system 100 to user. In one embodiment, the light associated with button 136 may automatically turn off once the steam process has been completed.

In FIG. 8, a cut-away view steaming system 100 is depicted, where housing 102 is in the closed configuration, and power cord 106 has been plugged into a 110 Volt power source in power outlet 750. Furthermore, power switch 130 has been switched to ON, and button 136 has been pressed to begin the automated steaming cycle.

Figure 9:
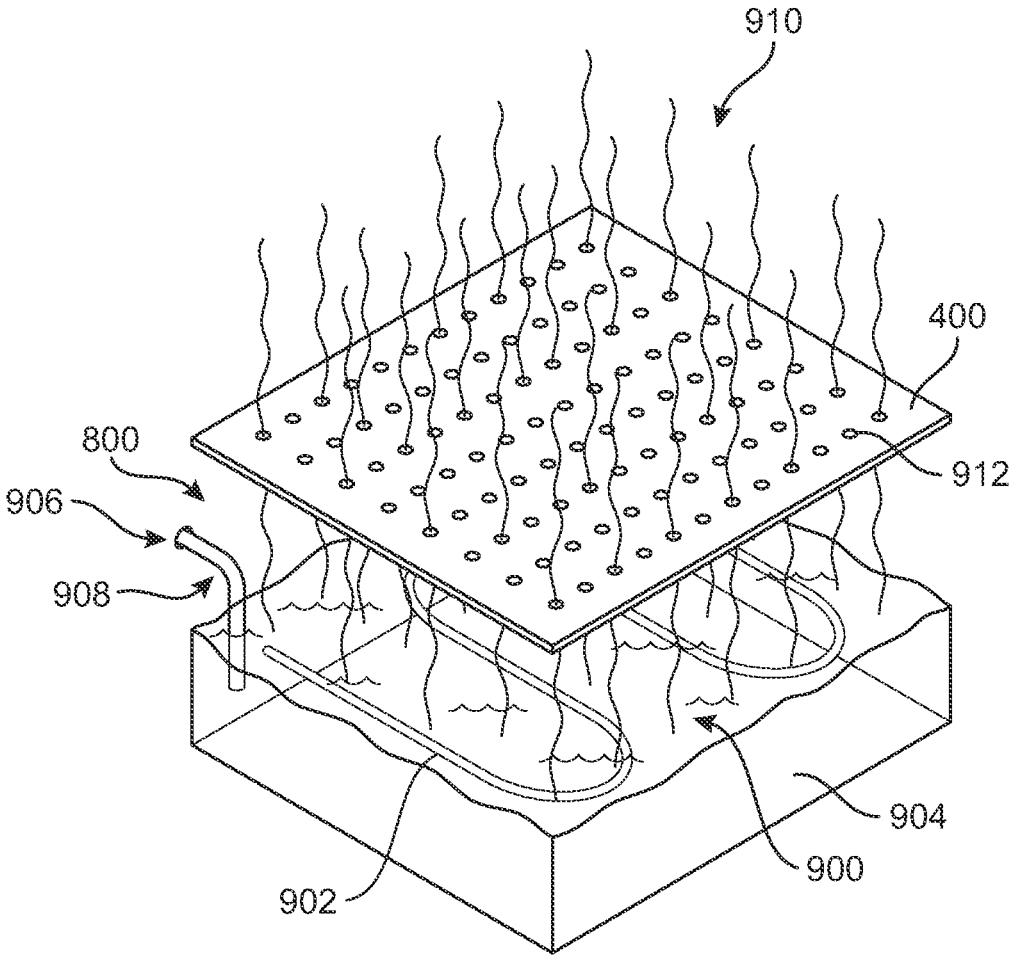
FIG. 9 is a schematic view of an embodiment of a heating chamber for a steaming system.

As shown in both FIGS. 8 and 9, steaming system 100 can include provisions for generating steam and providing the steam to steaming compartment 250. In some embodiments, a heating chamber 800 may be disposed within steaming system 100. In one embodiment, heating chamber 800 may be disposed near base portion 118 of housing 102, as shown in FIG. 8. In other embodiments, heating chamber 800 may be located in another area of housing 102 or be included in steaming system 100 separately from housing 102.

Referring to FIGS. 8 and 9, heating chamber 800 may include at least one heating element 902, a water supply line 908, and a chamber 904. In some embodiments, water 900 may be provided to heating chamber 800 through tube 150 extending from container 138 disposed along the exterior of housing 102. Tube 150 may channel water flow into housing 102 through an inlet 906, joining water supply line 908 into chamber 904. In some embodiments, water supply line 908 and tube 150 may be continuous. In other embodiments, water supply line 908 and tube 150 may comprise separate components. In one embodiment, inlet 906 may be formed in rear wall 116 of housing 102. In other embodiments, inlet 906 may be formed along any other portion of housing 102. Water 900 may then be transported into chamber 904 for heating.

In different embodiments, steaming system 100 may include provisions for regulating the flow of fluid into heating chamber 800. In some embodiments, for example, a ballcock may be used to help fill chamber 904 with water 900. In other embodiments, a different type of valve or device that regulates, directs, or controls the flow of a fluid (gases, liquids, fluidized solids) by opening, closing, or partially obstructing various passageways may be included. Some examples of mechanisms that may also be used by steaming system 100 to regulate water flow can include: a globe valve, a butterfly valve, quarter-turn valves, control valves, gate valves, needle valves, or other types of negative feedback controls or proportional controls. In one embodiment, steaming system 100 may automatically regulate the intake of water during the steam process, such that chamber 904 maintains the amount of water 900 needed to continue to generate steam.

Water 900 may be used in conjunction with heating element 902 in some embodiments. For purposes of this description, a heating element converts electricity into heat. In some embodiments, heat may be generated through the process of resistive heating. In some cases, heating element 902 may include metallic heating elements such as nichrome, resistance wire, etched foil, copper, steel, stainless steel, cast iron, Incoloy, titanium, and PFA coated, radiative heating elements, ceramic heating elements such as PTC, and/or composite heating elements such as tubular or screen printed elements. Heating element 902 may comprise a coil of relatively thick metal, a strip, or a ribbon of wire in some embodiments. When steaming system 100 is plugged into power outlet 750 (see FIGS. 7 and 8), electric current may be directed into heating element 902. The resistance of heating element 902 may turn the electrical energy into heat in some embodiments. In one embodiment, heating element 902 is in direct contact with water 900, where the heat may be passed on into the water (e.g., radiate, by conduction) to warm water 900.

Furthermore, in other embodiments, heating chamber 800 may comprise a condenser system. In some cases, heating chamber 800 may include a surface condenser. In one case, steaming system 100 may comprise a condenser unit with a heat exchanger section, a compressor, and/or a fan. A condenser may extract additional heat from the system, and efficiency of the system may be increased. In some cases, a condenser can be used to increase efficiency by using waste heat to pre-heat cold water entering the boiler.

In addition, steaming system 100 may be configured to regulate the temperature of heating chamber 800. In some cases, heating element 902 may include any type of built-in thermostatic control. In one case, a thermostat may be wired into the circuit of a magnetic contactor. In another case, the thermostatic control may be included in steaming system 100 as a separate component, and have a thermostatic sensing element disposed in water 900 or interior void 200.

In some embodiments, the desired temperature of water 900 may be selected by a user. In one embodiment, the temperature is pre-set or predefined (i.e., factory setting) at or around 100 degrees Celsius. In other words, upon initiation of the steaming process, water 900 can be heated to reach a temperature near the range of 100 degrees Celsius. Thus, the steaming process may be simplified as the temperature is pre-selected, and single button 136 used to initiate the entire process. In other embodiments, the temperature may be pre-set, predefined, or otherwise configured to heat water 900 between the range of 70-200 degrees Celsius. For example, because water may boil at lower temperatures when located at lower pressures, such as near the top of high mountains or high-altitude locales, steaming system 100 may be configured to a lower temperature than 100 degrees Celsius. In one embodiment, steaming system 100 can auto-shut down, alert a user, or be otherwise unable to heat water 900 to a temperature greater than a preselected maximum temperature (for example, 101 degrees) in order to protect articles 700 from superheated steam or other undesired heat exposure.

Thus, as water 900 is heated by heating element 902, water 900 may begin to boil in some embodiments. As a result, water 900 may form steam 910, or otherwise enter the gaseous phase. Steam 910 can rise above chamber 904 in different embodiments.

Steaming system 100 may include provisions for communication of steam 910 from heating chamber 800 to steaming compartment 250. In some embodiments, chamber 904 may be at least partially covered by perforated plate 400. Perforated plate 400 may be a substantially flat or two-dimensional material comprising a plurality of perforations 912. The size, arrangement, and shape of perforations 912 may vary in different embodiments. Smaller perforations 912 may slow the transport of steam 910 to steaming compartment 250 above, while larger perforations 912 may hasten the movement of steam 910. Furthermore, by arranging perforations 912 in one area, steam 910 can be directed to a specific portion of articles 700 if so desired. In one embodiment, perforations 912 are arranged in a substantially uniform manner across perforated plate 400. Perforated plate 400 may thus provide a regulated flow of steam 910 into steaming compartment 250 in some embodiments, providing a steady and relatively even exposure of steam 910 to articles 700. In one embodiment, perforated plate 400 may be configured to allow fluid communication between heating chamber 800 and steaming compartment 250. Furthermore, in one embodiment, steam 910 may be low pressure steam, exposing articles 700 to a relatively low level of heat intensity.

In some embodiments, the desired duration of exposure to steam 910 or steam process may be selected or chosen by the user. In other embodiments, the duration is pre-set or predefined (i.e., factory setting). In some cases, the duration may be pre-set to a time between five minutes and 20 seconds. In one case, the duration is pre-set to around 45 seconds. In other words, upon beginning the steaming process, water 900 will be heated and/or steam can be generated for a pre-define period of time. Thus, in one embodiment, the steaming process may be greatly simplified as the time is pre-selected, and single button 136 used to initiate the entire cycle. In other embodiments, the duration may be pre-set, predefined, or otherwise configured to heat water 900 between a range of 10-100 seconds, or over 100 seconds. For example, when steaming articles that comprise various materials, the articles may require a greater—or lesser—length of exposure time to steam in order to achieve the pliability necessary for customization. In another embodiment, the materials used in articles 700 may be relatively more delicate, and a shorter exposure may be desired. In one embodiment, steaming system 100 can provide a timer or an indicator displaying the amount of time that has passed so that user can turn off system when desired.

It should be understood that, in other embodiments, once the power to steaming system 100 has been switched to ON, steaming system 100 may transition to a "readiness" setting. In other words, steaming system 100 may be pre-heated in some embodiments, such that the time required to achieve boiling and/or generate steam is shortened. Thus, once the steaming process has been initiated, steam can be generated relatively quickly as steaming system 100 is able to begin to warm the water prior to button 136 being pressed.

Figure 10:
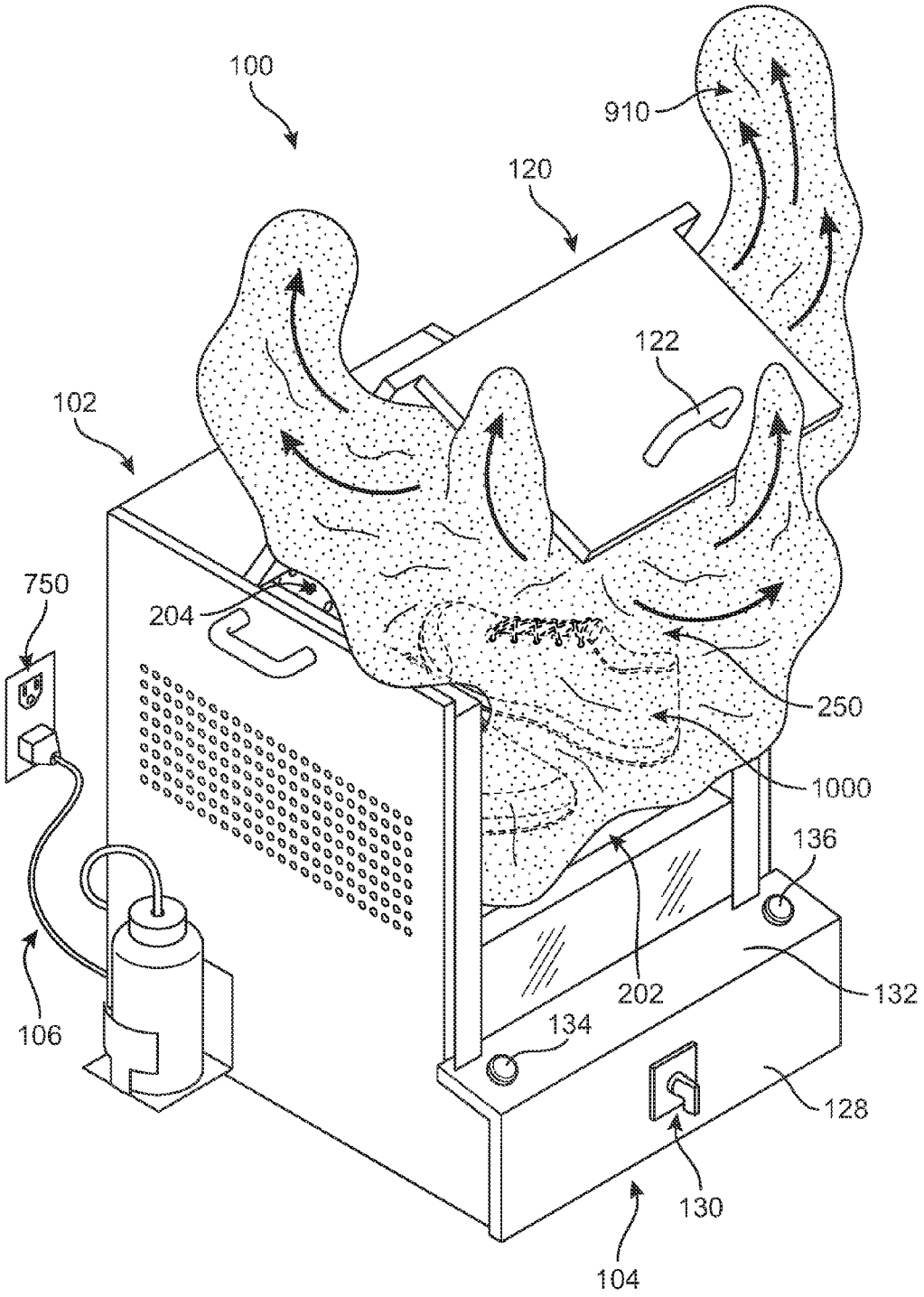
FIG. 10 is a schematic view of an embodiment of a steaming system in its open configuration.

Upon completion of the steaming of articles 700, the electric current supplied to heating element 902 may be discontinued or heating element 902 may be otherwise turned into an off mode, such that heating element 902 may begin to cool. As shown in FIG. 10, lid 120 may be lifted, and housing 102 opened, releasing steam 910. In one embodiment, when steam cycle has concluded, the light associated with button 136 may also turn off, visually informing a user that articles 700 may be removed. In other embodiments, there may be aural indications regarding the status of steaming system 100.

In different embodiments, steaming system 100 may include provisions for rapidly evacuating steam 910 from the system. As discussed with respect to FIGS. 5 and 6, steaming system 100 may include one or more areas of ventilation, including apertures 516. Furthermore, in one embodiment, as depicted in FIG. 10, it can be seen that the configuration of housing 102 and lid 120 may allow for the prompt release of steam 910 in a short period of time. For example, in some embodiments, steam 910 may escape from both first opening 202 and second opening 204, and rapidly pass into the air. In one embodiment, the rapid evacuation of steam 910 may allow a user to easily access steaming compartment 250 and steamed articles 1000 soon after the lifting of lid 120. Thus, steam 910 may be provided with an escape along two different directions and planes (see discussion above regarding lid and housing configuration, including first opening 202 and second opening 204, with respect to FIGS. 3 and 4). This feature may further facilitate the use of steaming system 100 by quickly lowering the temperature of steaming compartment 250 in order to allow the handling of steamed articles 1000 by a person. In situations where steamed articles 1000 are needed quickly (e.g., for players to use before a game), this feature may be significant.

In FIG. 10, steamed articles 1000 are represented by a pair of footwear that may be configured for customization by a user. After recovery of steamed articles 1000 from steaming compartment 250, a user may wear steamed articles 1000 to initiate customization. For example, a user may insert a foot into each of steamed articles 1000. At this point, the customizable portion(s) may conform to the shape of the foot as the steamed articles 1000 cool. Thus, steaming system 100 may be capable of producing articles of footwear that are customized to a user's foot. Moreover, the production of the steamed articles can occur relatively quickly, and may be as short as the combined time needed to place the articles into steaming system 100, turn on the system, run the steaming cycle, and open the housing 102 to remove articles. Although the time required for each step could vary in different embodiments, embodiments could provide a total time of less than two minutes. In at least some embodiments, the time required for each step may be selected so that the total customization time (including the fitting to a user's foot) is between 15-30 minutes. In still further embodiments, the total customization time is less than fifteen minutes.

It should be understood that the various mechanical and/or electrical components of steaming system 100 may be located in different parts of housing 102. In one embodiment, base portion 118 or regions adjacent to base portion 118 may house the primary mechanical components. In one embodiment, mechanical components may be disposed beneath heating chamber 800.

As noted above, steaming system 100 may be man-portable in some embodiments. This feature may allow for the use of steaming system 100 at any remote location where the system can be delivered (e.g., by hand-carry, and/or via compact car, wagon, dolly, cart) and where housing 102 can fit (e.g., in a locker room, on a desk, under a table, etc.). Steaming system 100 to be delivered to, for example, a retail location (such as a store front). Such a system could also be used on location at various sporting events. In such situations, players and/or fans at a sporting event could have customized articles prepared for them at the location of a sporting event. Thus, in one embodiment, housing 102 may be easily moved by a single user from one location to another location. Examples of starting locations and/or destinations for housing 102 include various manufacturing facilities, retail locations (e.g., shoe and/or apparel stores), trade shows and/or conventions, residential homes, university or school campuses, sporting facilities (e.g., a stadium or practice facility for one or more sports teams), as well as possibly other locations.

Thus, steaming system 100 may include provisions for facilitating the customization of articles in different environment and locations. For example, in situations where frequent "breaking-in" of apparel is needed (e.g., sports players who may use over 7-12 pairs of articles of footwear each season) steaming system 100 may provide increased convenience, as well as great utility, by allowing players to have articles quickly steamed for customization soon before a match or sporting event. In another embodiment, some users may have injuries or conditions that require the use of specialized ankle or footwear support. The use of steaming system 100 can easily allow the user to steam their respective footwear and then insert their foot (while wearing the footwear support) into steamed articles 1000 to help achieve an improved fit within a few minutes, and at a location convenient to them.

It should be understood that in different embodiments, steaming system 100 may be operated by any person configured (i.e., trained) to operate one or more systems or devices of steaming system 100. Furthermore, in order to facilitate the use of steaming system 100, the system may include provisions for instructing a user about how to operate steaming system 100. In one embodiment, steaming system 100 can include set of instructions. Generally, the instructions can be supplied in any format. In some cases, there may be a printed copy of instructions, such as a booklet, or a digital storage device. In other embodiments, instructions may be located on housing 102. In one embodiment, interior surface 206 or exterior surface 208 of lid 120 may include a set of instructions. This may facilitate the use of steaming system 100 by individuals who are unfamiliar with the operation of steaming system 100, and can allow the system to be used relatively quickly (i.e., within a short period of time) by most laypeople.

This description of features, systems, and components is not intended to be exhaustive and in other embodiments, steaming system 100 may include features, systems and/or components. Moreover, in other embodiments, some of these features, systems and/or components could be optional. As an example, some embodiments may not include sleeves 504 within housing 102.

While various embodiments have been described, the description is intended to be exemplary, rather than limiting and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. A man-portable steaming system, comprising:

a portable housing;

a compartment configured to receive one or more articles of apparel;

a plurality of rails included in the compartment, the plurality of rails configured to receive one or more articles for steaming;

the housing including a first sidewall, a second sidewall, and a lid;

wherein the compartment includes a first recess disposed adjacent to the first sidewall and a second recess disposed adjacent to the second sidewall;

wherein the lid includes a first ledge portion and a second ledge portion;

wherein the first ledge portion of the lid is configured to rest in the first recess and the second ledge portion of the lid is configured to rest in the second recess in a closed state of the housing;

a heating chamber configured to provide steam to the compartment; and a power cord.

2. The steaming system according to claim 1, further comprising a portable and refillable container, and wherein the container is configured to supply water to the steaming system.

3. The steaming system according to claim 2, wherein the water utilized by the steaming system includes tap water.

4. The steaming system according to claim 1, wherein the first recess has a first depth that is substantially similar to a first thickness of the first ledge portion, and wherein the first recess is configured to receive the first ledge portion such that the lid is substantially level with a top portion of the housing when the housing is in the closed state.

5. The steaming system according to claim 1, wherein the lid comprises a first wall joined to a second wall, and wherein the first wall includes the first ledge portion and the second ledge portion.

6. The steaming system according to claim 1, wherein the plurality of rails include a heat insulation material.

7. A steaming system, comprising:

a housing, the housing including a first sidewall, a second sidewall, a front wall, a rear wall, a top portion, a lid, and a base portion;

wherein the first sidewall, the second sidewall, the front wall, and the rear wall are each attached to the base portion;

wherein the housing includes an open state and a closed state;

wherein the lid comprises a first wall and a second wall;

wherein the lid includes a bent region, and wherein the first wall and the second wall are joined together along the bent region;

wherein the second wall is joined to the top portion by a hinge portion;

wherein the lid is raised to form a first opening and a second opening when the housing is in the open state;

wherein the second wall of the lid directly contacts and rests upon the top portion of the housing in the open state;

wherein the first opening is disposed along a plane associated with the front wall;

wherein the second opening is disposed along a plane associated with the top portion;

a compartment configured to receive one or more articles of apparel;

a plurality of rails included in the compartment, the plurality of rails configured to receive one or more articles for steaming;

a heating chamber configured to provide steam to the compartment; and wherein the steam evacuates the compartment through the first opening and the second opening when the housing is in the open state.

8. The steaming system according to claim 7, wherein the lid is substantially L-shaped.

9. The steaming system according to claim 7, wherein the second wall of the lid comprises a portion of the top portion of the housing when the housing is in the closed state.

10. The steaming system according to claim 9, wherein the first wall of the lid comprises a portion of the front wall when the housing is in the closed state.

11. The steaming system according to claim 10, wherein the heating chamber includes a heating element submerged in water.

12. The steaming system according to claim 7, further comprising an operations panel, wherein the operations panel includes a button, wherein the button is configured to start a steaming cycle when the button is pressed.

13. The steaming system according to claim 12, wherein the steaming system is configured to automatically turn off at an end of the steaming cycle.

14. A steaming system, comprising:

a housing, the housing including a first sidewall, a second sidewall, and a base portion;

wherein the first sidewall and the second sidewall are each attached to the base portion;

a steaming compartment configured to receive one or more articles of apparel;

the base portion including a heating chamber configured to heat water and provide steam to the steaming compartment;

a plurality of rails, the plurality of rails including a first rail;

the first rail extending from the first sidewall to the second sidewall;

the first rail being configured to receive at least a portion of one or more articles of apparel;

a plurality of sleeves, the plurality of sleeves including a first sleeve;

the first rail being disposed within the first sleeve; and wherein the first sleeve is configured to protect the first rail.

15. The steaming system according to claim 14, wherein the heating chamber further comprises a heating element.

16. The steaming system according to claim 15, wherein the heating chamber further includes a compartment for holding the water, and wherein the heating element is in direct contact with the water.

17. The steaming system according to claim 15, wherein the steaming system includes a button and wherein the water is heated to a predefined temperature of at least 100 degrees Celsius when the button is pressed.

18. The steaming system according to claim 14, further comprising a perforated plate, wherein the perforated plate is disposed between the heating chamber and the steaming compartment, wherein the perforated plate includes a plurality of perforations, and wherein the perforations are configured to provide fluid communication between the heating chamber and the steaming compartment.

19. The steaming system according to claim 14, wherein the plurality of sleeves are configured to be readily removable and replaceable.

20. The steaming system according to claim 19, wherein the plurality of rails are configured to be readily removable and replaceable.

21. The steaming system according to claim 19, wherein the first sleeve is configured to prevent contact between an article placed within the steaming compartment and the first rail.

22. The steaming system according to claim 14, wherein the plurality of rails includes a second rail, and wherein the first rail and the second rail are arranged so as to provide a stable surface for placement of an article of apparel.

* * * * *